US008726782B2

(12) United States Patent
White

(10) Patent No.: US 8,726,782 B2
(45) Date of Patent: May 20, 2014

(54) BULLET RESISTANT BARRIER

(75) Inventor: Collins White, Syracue, NY (US)

(73) Assignee: Defenshield, Inc., East Syracuse, NY (US)

( * ) Notice: Subject to any disclaimer, the term of this patent is extended or adjusted under 35 U.S.C. 154(b) by 0 days.

(21) Appl. No.: 12/885,794

(22) Filed: Sep. 20, 2010

(65) Prior Publication Data

US 2011/0005377 A1 Jan. 13, 2011

Related U.S. Application Data

(60) Continuation of application No. 11/160,079, filed on Jun. 8, 2005, now Pat. No. 7,849,781, which is a division of application No. 10/243,508, filed on Sep. 14, 2002, now Pat. No. 6,907,811.

(60) Provisional application No. 60/361,768, filed on Mar. 5, 2002.

(51) Int. Cl.
*F41A 5/14* (2006.01)

(52) U.S. Cl.
USPC ..... 89/36.09

(58) Field of Classification Search
CPC ..... F41H 5/12; F41H 5/14; F41H 5/24; F41H 5/263
USPC ..... 89/36.07, 36.09; 109/49.5
See application file for complete search history.

(56) References Cited

U.S. PATENT DOCUMENTS

| | | | |
|---|---|---|---|
| 772,055 | A | 10/1904 | Post |
| 1,253,964 | A | 1/1918 | Hack |
| 1,261,518 | A | 4/1918 | Hahre |
| 1,274,721 | A | 8/1918 | Krzan |
| 1,281,400 | A | 10/1918 | Larnell |
| 1,327,464 | A | 1/1920 | Dewick et al. |
| 1,465,042 | A | 8/1923 | Hruska |
| 1,875,488 | A | 9/1932 | Peters |
| 2,370,596 | A | 2/1945 | Wallace |
| 2,613,243 | A | 10/1952 | Frear |
| 2,845,153 | A | 7/1958 | West |

(Continued)

FOREIGN PATENT DOCUMENTS

| | | |
|---|---|---|
| DE | 64291 C | 2/1892 |
| DE | 2412568 | 9/1975 |

(Continued)

OTHER PUBLICATIONS

Attachment 1; 2 pages; pp. 9/14 and 11/14 with examiner's labeling of WO 94/29665.

(Continued)

*Primary Examiner* — Stephen M Johnson
(74) *Attorney, Agent, or Firm* — Baker & Hostetler LLP

(57) ABSTRACT

A barrier comprising a base unit composed of a bullet resistant material and a transparent upper wall removably interconnected to the base unit and composed of a bullet resistant material. The base unit includes a front wall and two side walls extending from the front wall to provide protection to the front and sides of a person standing behind the barrier. A series of casters, preferably locking casters, are attached to the bottom edges of the side walls, and a pair of handles connected to each of the side walls permitting the barrier to be conveniently transported from one site to another.

16 Claims, 5 Drawing Sheets

(56) References Cited

U.S. PATENT DOCUMENTS

| | | | | | |
|---|---|---|---|---|---|
| 2,878,054 | A | * | 3/1959 | Linder | 296/190.11 |
| 2,937,602 | A | * | 5/1960 | Norris | 109/12 |
| 2,985,174 | A | | 5/1961 | Guth | |
| 3,039,161 | A | | 6/1962 | Gagnon | |
| 3,590,685 | A | | 7/1971 | Lane | |
| 3,712,005 | A | | 1/1973 | Eschbach et al. | |
| 3,942,598 | A | * | 3/1976 | Council | 180/6.5 |
| 3,994,243 | A | | 11/1976 | Anders | |
| 4,030,219 | A | | 6/1977 | Donovan | |
| 4,061,093 | A | * | 12/1977 | Carstens et al. | 109/19 |
| 4,245,546 | A | | 1/1981 | Chaires | |
| 4,351,558 | A | * | 9/1982 | Mueller | 296/203.01 |
| 4,416,485 | A | | 11/1983 | Long | |
| 4,674,394 | A | * | 6/1987 | Martino | 89/36.05 |
| 4,781,101 | A | | 11/1988 | Zevuluni et al. | |
| 4,901,964 | A | | 2/1990 | McConnell | |
| 4,949,490 | A | | 8/1990 | Miller | |
| 4,953,820 | A | | 9/1990 | Yoder | |
| 5,244,172 | A | | 9/1993 | Allega | |
| 5,293,807 | A | | 3/1994 | Hajdu | |
| 5,368,904 | A | | 11/1994 | Stephinson | |
| 5,419,479 | A | | 5/1995 | Evels et al. | |
| 5,438,908 | A | | 8/1995 | Madden, Jr. | |
| 5,560,149 | A | | 10/1996 | Lafevre | |
| 5,641,934 | A | | 6/1997 | Follett | |
| 5,666,773 | A | | 9/1997 | Librande et al. | |
| 5,703,316 | A | | 12/1997 | Madden, Jr. | |
| 5,829,653 | A | | 11/1998 | Kaiser | |
| 5,857,730 | A | | 1/1999 | Korpi et al. | |
| 5,878,519 | A | | 3/1999 | Huyck et al. | |
| 5,953,820 | A | | 9/1999 | Vasudeva | |
| 6,000,347 | A | | 12/1999 | Madden, Jr. | |
| 6,116,326 | A | | 9/2000 | Domina et al. | |
| 6,170,379 | B1 | | 1/2001 | Taylor | |
| 6,333,085 | B1 | | 12/2001 | Emek | |
| 6,622,607 | B1 | | 9/2003 | Miller | |
| 6,907,811 | B2 | | 6/2005 | White | |
| 6,962,461 | B2 | | 11/2005 | Choi et al. | |
| 7,069,680 | B1 | | 7/2006 | Crawford | |
| 7,104,720 | B2 | | 9/2006 | Humphries et al. | |
| 7,128,308 | B2 | | 10/2006 | Marsh et al. | |
| 7,520,207 | B1 | | 4/2009 | Fuqua et al. | |
| 7,849,781 | B2 | | 12/2010 | White | |
| 7,891,283 | B2 | | 2/2011 | Kleniatis et al. | |
| 2003/0167911 | A1 | | 9/2003 | White | |
| 2004/0255769 | A1 | | 12/2004 | Drackett | |
| 2005/0265780 | A1 | | 12/2005 | Humphries et al. | |
| 2006/0000671 | A1 | | 1/2006 | Nolley | |

FOREIGN PATENT DOCUMENTS

| | | |
|---|---|---|
| FR | 462049 | 1/1914 |
| FR | 2607238 | 5/1988 |
| MO | WO 2009/048650 | 4/2009 |
| WO | WO 94/29665 | 12/1994 |

OTHER PUBLICATIONS

International Patent Application No. PCT/US2008/062692 filed May 5, 2008: International Search Report dated Apr. 16, 2009, 4 pages.

"*Defenshield, Inc.* v. *First Choice Armor & Equipment, Inc.* Civil Docket," in the United States District Court for The Northern District of New York—Main Office (Syracuse), Case No. 5:10-cv-01140-GTS-DEP, filed Sep. 22, 2010, 5 pages.

"Complaint," In the United States District Court for the Northern District of New York, Case No. 5:10-CV-1140 (GTS/DEP), filed Sep. 22, 2010, 18 pages.

"Report on the Filing or Determination of an Action Regarding a Patent or Trademark," In the United States District Court for the Northern District of New York, Case No. 5:10-cv-1140, filed Sep. 22, 2010, 1 page.

"First Amended Complaint," In the United States District Court for the Northern District of New York, Case No. 5:10-cv-01140-GTS-DEP, filed Sep. 29, 2010, 17 pages.

"Rule 7.1 Disclosure Statement," In the United States District Court for the Northern District of New York, Case No. 5:10-cv-01140 (GTS)(DEP), filed Oct. 25, 2010, 1 page.

"Notice of Motion," In the United States District Court for the Northern District of New York, Case No. 5:10-cv-01140 (GTS)(DEP), filed Oct. 25, 2010, 26 pages.

"Memorandum of Law in Opposition to Defendants' Motion to Dismiss and Transfer Venue," In the United States District Court for the Northern District of New York, Case No. 5:10-cv-01140 (GTS)(DEP), filed Nov. 15, 2010, 77 pages.

"First Choice Inc.'s and Diamondback Acquisition Co.'s Reply in Support of Their Motion to Dismiss and Transfer Venue," In the United States District Court for the Northern District of New York, Case No. 5:10-cv-01140 (GTS)(DEP), filed Nov. 22, 2010, 100 pages.

"*D-Back Acquisition Co.* v. *Defenshield, Inc.* Civil Docket," In the United States District Court for the Western District of North Carolina (Asheville), Case No. 1:10-cv-00266-MR, filed Nov. 10, 2010, 4 pages.

"Complaint," In the United States District Court for the Western District of North Carolina Asheville Division, Case No. 1:10 CV 266, filed Nov. 10, 2010, 60 pages.

"Disclosure of Corporate Affiliations and Other Entities with a Direct Financial Interest in Litigation," In the United States District Court for the Western District of North Carolina Asheville Division, Case No. 1:10 CV 00266, filed Nov. 10, 2010, 2 pages.

"Report on the Filing or Determination of an Action Regarding a Patent or Trademark," In the United States District Court for the Western District of North Carolina Asheville Division, Case No. 1:10 CV 266, filed Nov. 10, 2010, 1 page.

"Defendant's Motion to Dismiss or, Alternatively, Motion to Change Venue," In the United States District Court for the Western District of North Carolina Asheville Division, Case No. 01:10 CV 266, filed Dec. 6, 2010, 86 pages.

"Rule 7.1 Statement of Defendant Defenshield Inc.," In the United States District Court for the Western District of North Carolina Asheville Division, Case No. 1:10-CV-266, filed Dec. 6, 2010, 3 pages.

"Plaintiff's Motion to Stay Ruling on Defendant's Motion to Dismiss or to Change Venue," In the United States District Court for the Western District of North Carolina Asheville Division, Case No. 1:10 CV 00266-MR, filed Dec. 23, 2010, 5 pages.

"Order," In the United States District Court for the Western District of North Carolina Asheville Division, Case No. 1:10-CV-00266, filed Jan. 24, 2011, 2 pages.

"Order," In the United States District Court for the Western District of North Carolina Asheville Division, Case No. 1:10 CV 266, filed Aug. 15, 2011, 1 page.

Exhibit A, Case No. 5:10-cv-01140-GTS-DEP, Document 24-1, filed Apr. 12, 2012, 4 pages.

Exhibit B, Case No. 5:10-cv-01140-GTS-DEP, Document 24-2, filed Apr. 12, 2012, 8 pages.

Exhibit C, Case No. 5:10-cv-01140-GTS-DEP, Document 24-3, filed Apr. 12, 2012, 10 pages.

Exhibit D, Case No. 5:10-cv-01140-GTS-DEP, Document 24-4, filed Apr. 12, 2012, 3 pages.

Exhibit E, Case No. 5:10-cv-01140-GTS-DEP, Document 24-5, filed Apr. 12, 2012, 4 pages.

"Answer", In the United States District Court Northern District of New York, Case no. 5:10-cv-01140-GTS-DEP, document 24, filed Apr. 12, 2012, 12 pages.

"Plaintiff's Memorandum of Law in Support of Motion for Leave to File an Amended Complaint", In the United States District Court for the Northern District of New York, Case No. 5:10-cv-01140-GTS-DEP, Document 29-1, filed Jun. 13, 2012, 13 Pages.

"Declaration of David L. Nocilly in Support of Plaintiff's Motion for Leave to Amend", In the United States District Court for the Northern District of New York, Case No. 5:10-cv-01140-GTS-DEP, Document 29-2, filed Jun. 13, 2012, 30 pages.

"Certificate of Service", In the United Stated District Court for the Northern District of New York, Case No. 5:10-cv-01140-GTS-DEP, Document 29-3, Filed Jun. 13, 2012, p. 1.

(56) References Cited

OTHER PUBLICATIONS

"Notice of Motion for Leave to File an Amended Complaint", In the United States District Court for the Northern District of New York, Case No. 5:10-cv-01140-GTS-DEP, Document 29, filed Jun. 13, 2012, 2 pages.
"Confidentiality Order", In the United States District Court for the Northern District of New York, Case No. 5:10-cv-01140-GTS-DEP, Document 30-1, Filed Jun. 15, 2012, 9 pages.
*Defenshield Inc.* v. *First Choice Armor & Equipment, Inc. et al.*, In the United States District Court for the Northern District of New York—Main Office(Syracuse), Case No. 5:10-cv-01140-GTS-DEP, Document 30, Filed Jun. 15, 2012, p. 1.
"Certificate of Service" Case No. 5:10-cv-01140-GTS-DEP, Document 32-1, Filed Jul. 9, 2012, p. 1.
*Defenshield, Inc.* v. *First Choice Armor & Equipment, Inc. et al.*, In the United States District Court for the Northern District of New York, Case No. 5:10-cv-01140-GTS-DEP, Document 32, Filed Jul. 9, 2012, p. 1.
Exhibit A, Case No. 5:10-cv-01140-GTS-DEP, Document 34-1, Filed Aug. 1, 2012, 4 pages.
Exhibit B, Case No. 5:10-cv-01140-GTS-DEP, Document 34-2, Filed Aug. 1, 2012, 11 pages.
Exhibit C, Case No. 5:10-cv-01140-GTS-DEP, Document 34-3, Filed Aug. 1, 2012, 10 pages.
Exhibit D, Case No. 5:10-cv-01140-GTS-DEP, Document 34-4, Filed Aug. 1, 2012, 3 pages.
Exhibit E, Case No. 5:10-cv-01140-GTS-DEP, Document 34-5, Filed Aug. 1, 2012, 4 pages.
"Certificate of Service", In the United States District Court Northern District of New York, Case No. 5:10-cv-01140-GTS-DEP, Document 34-6, Filed Aug. 1, 2012, p. 1.
"Defendants' Answer to Plaintiff's Second Amended Complaint" In the United States District Court Northern District of New York, Case No. 5:10-cv-01140-GTS-DEP, Document 34, Filed Aug. 1, 2012, 12 pages.
"Memorandum-Decision and Order", In the United States District Court Northern District of New York, Case No. 5:10-cv-01140-GTS-DEP, Document 23, Filed Mar. 29, 2012, 29 pages.
*Defenshield Inc.* v. *First Choice Armor & Equipment, Inc. and D-Back Acquisition Co.*, Civil Case Mangagement Plan, In the United States District Court Northern District of New York, Case No. 5:10-cv-01140-GTS-DEP, Document 27, Filed May 23, 2012, pp. 8.
"Uniform Pretrial Scheduling Order", In the United States District Court Northern District of New York, Case No. 5:10-cv-01140-GTS-DEP, Document 28, Filed May 29, 2012, pp. 23.
"Confidentiality Order" In the United States District Court Northern District of New York, Case No. 5:10-cv-01140-GTS-DEP, Document 31, Filed Jun. 19, 2012, 9 pages.
"Second Amended Complaint" In the United States District Court Northern District of New York, Case No. 5:10-cv-01140-GTS-DEP, Document 33, Filed Jul. 11, 2012, 20 pages.
"Joint Claim Construction Statement", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 35, Filed Oct. 19, 2012, pp. 1-10.
"Defendant's Opening Markman Brief", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 36, Filed Dec. 3, 2012, pp. 1-38.
"Plaintiff's Opening Markman Brief", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 37, Filed Dec. 3, 2012, pp. 1-18.
"Declaration of David L. Nocilly", *Defenshield Inc.* v. *First Choice Armor & Equipment, Inc.* In the United States District Court for the Northern District of New York, Case No. 5:10-cv-01140-GTS-DEP, Document 37-1, Filed Dec. 3, 2012, pp. 1-2.
"Plaintiff's Responsive Markman Brief", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 38, Filed Jan. 2, 2013, pp. 1-13.
"Defendant's Rebuttal Markman Brief", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 39, Filed Jan. 3, 2013, pp. 1-15.
"Magistrate Judge Markman Report and Recommendation", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 40, Filed Jan. 8, 2013, pp. 1-19.
"Defendants' Objections to Magistrate's Report and Recommendation", *Defenshield Inc.* v *First Choice Armor & Equipment, Inc. and D-Back Acquisition Co.*, In the United States District Court for the Northern District of New York, Case No. 5:10-cv-01140-GTS-DEP, Document 41, Filed Mar. 22, 2013, pp. 1-10.
"Plaintiff's Memorandum of Law in Response to Defendants' Objection", *Defenshield Inc.* v. *First Choice Armor & Equipment, Inc. and D-Back Acquisition Co.*, In the United States District Court for the Northern District of New York, Case No. 5:10-cv-01140-GTS-DEP, Document 43, Filed Apr. 4, 2013, pp. 1-16.

* cited by examiner 18
48
46
42
40
24
38
28
22
26
20
26
16
28
34

18
48
10
42
5
42
46
32
5
44
38
34
28
36
30
26
16
28
1
26

BULLET RESISTANT BARRIER

CROSS-REFERENCE TO RELATED APPLICATION

The present application is a continuation of, and claims priority to, U.S. Non-provisional patent application Ser. No. 11/160,079, now U.S. Pat. No. 7,849,781, filed on Jun. 8, 2005, which was a divisional of, and claimed priority to, Non-provisional patent application Ser. No. 10/243,508, now U.S. Pat. No. 6,907,811, filed on Sep. 14, 2002, which claimed priority to U.S. Provisional Patent Application Ser. No. 60/361,768 filed Mar. 5, 2002, the contents of all of which are hereby incorporated by reference in their entireties

BACKGROUND OF THE INVENTION

The present invention relates generally to bullet resistant barriers, and more particularly to such barriers that are portable.

There are many locations and situations where law enforcement/security personnel or others, such as workers in financial institutions, are regularly placed in harm's way. If the individuals are located in the same station everyday, that station may be equipped with bullet resistant properties to protect the occupant. However, in situations when the personnel must be mobile or move to various locations, it would be useful to have some bullet resistant barrier that could be moved with them. In addition, it would be useful for such a barrier to provide bullet resistant coverage to the personnel's entire body.

It is therefore a principal object and advantage of the present invention to provide a bullet resistant barrier that is movable.

It is a further object and advantage of the present invention to provide a bullet resistant barrier that provides protection to the entire body of an occupant.

It is an additional object and advantage of the present invention to provide a bullet resistant barrier that may be broken down for ease of transport.

Other objects and advantages of the present invention will in part be obvious, and in part appear hereinafter.

SUMMARY OF THE INVENTION

In accordance with the foregoing objects and advantages, the present invention contemplates a barrier comprising a base unit composed of a bullet resistant material, such as metal, plastic, ceramic or a composite material, and a transparent upper wall removably interconnected to the base unit and composed of a bullet resistant material, such as a bullet resistant plastic or glass. The base unit includes a front wall and two side walls extending from the front wall to provide protection to the front and sides of a person standing behind the barrier. A series of casters, preferably locking casters, are attached to the bottom edges of the side walls, and a pair of handles are connected to each of the side walls permitting the barrier to be conveniently transported from one site to another.

A bracket assembly comprising first and second upstanding channel members interconnected by an S-shaped double channel member extending transversely there between serves to removably interconnect the upper wall to the base unit. The S-shaped member hooks over the upper edge of the front wall with its lower channel being positioned to receive the bottom edge of the upper wall. The two upstanding channel members are positioned at opposite ends of the S-shaped member and engage the opposite side edges of the upper wall. The upper wall may be slid into or out of engagement with this bracket assembly, thereby facilitating convenient break-down of the barrier.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
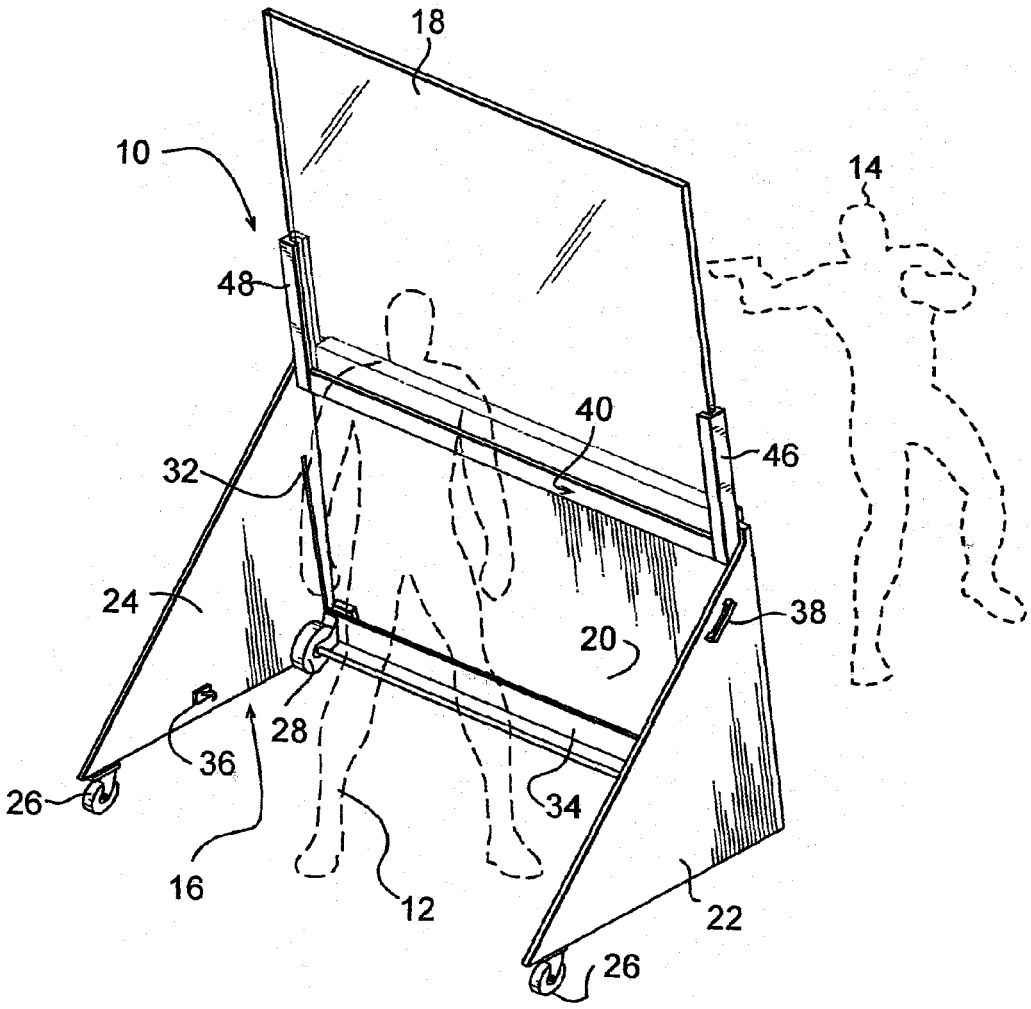
FIG. 1 is a perspective view illustrating use of the present invention.
Figure 2:
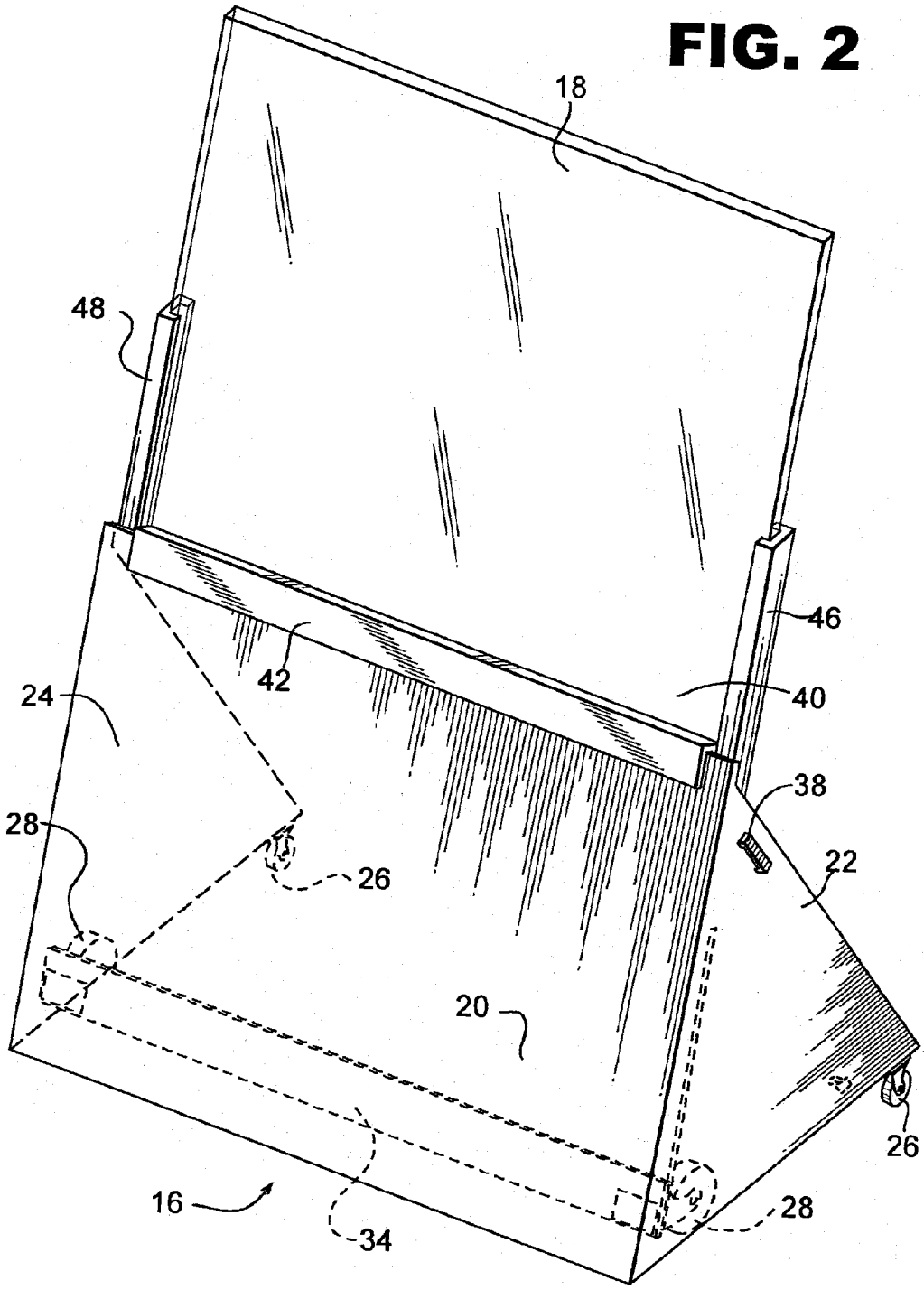
FIG. 2 is a front perspective view of the present invention.
Figure 3:
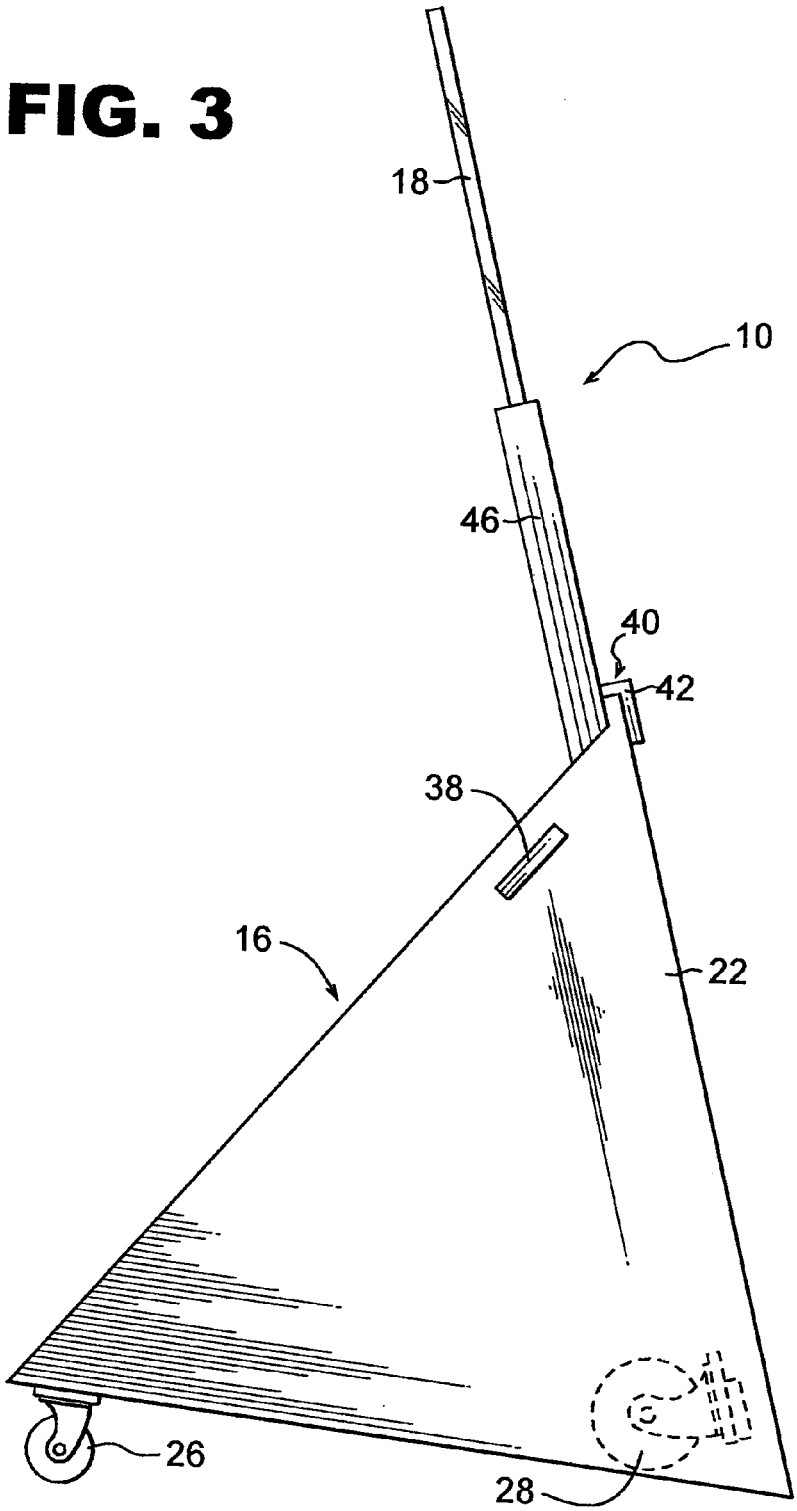
FIG. 3 is a side elevation view of the present invention.
Figure 4:
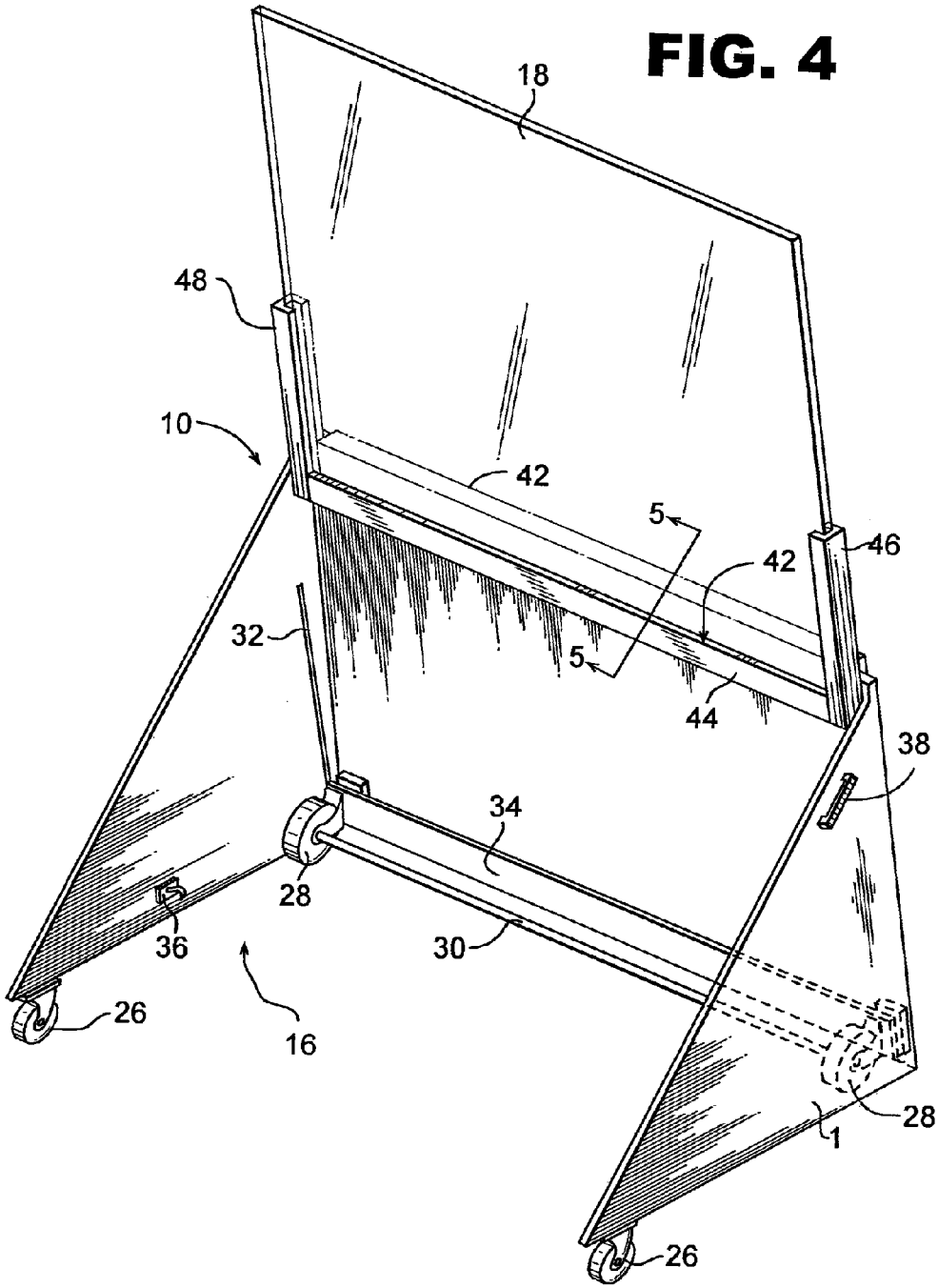
FIG. 4 is a rear perspective view of the present invention.

Referring now to the drawings, wherein like reference numerals refer to like parts throughout, there is seen in FIG. 1 a barrier device designated generally by reference numeral 10, designed to protect personnel (a "target") 12 from the gunshots of a perpetrator (a "source") 14. Barrier 10 generally comprises a base unit 16 and a transparent, upper wall 18 removably interconnected to the base unit, both of which are composed of bullet resistant materials (for instance, base unit 16 may be composed of metal, plastic, ceramic or a composite material, and upper wall 18 may be composed of Bullet resisting Plastic or Glass).

Base unit 16 comprises a front wall 20 and two side walls 22, 24 which extend perpendicularly rearward from opposing side edges of front wall 20. A first pair of casters 26 are connected to the bottom edges of side walls 22, 24, and a second pair of casters 28 interconnected to one another by an axle 30 are pivotally attached to front wall 20 in order to be moveable into or out of engagement with the ground. A rod 32 and locking bar 34 may be used by "target" 12 to lock/unlock casters 28 and pivotally move them into or out of engagement with the ground (rod 32 may snap into bracket 36 mounted to the interior surface of side wall 24 to lock casters 28 in engaging relation with the ground). To assist in moving barrier 10, handles 38 are mounted to the exterior surfaces of side walls 22, 24 for grasping by the person moving the unit.

Figure 5:
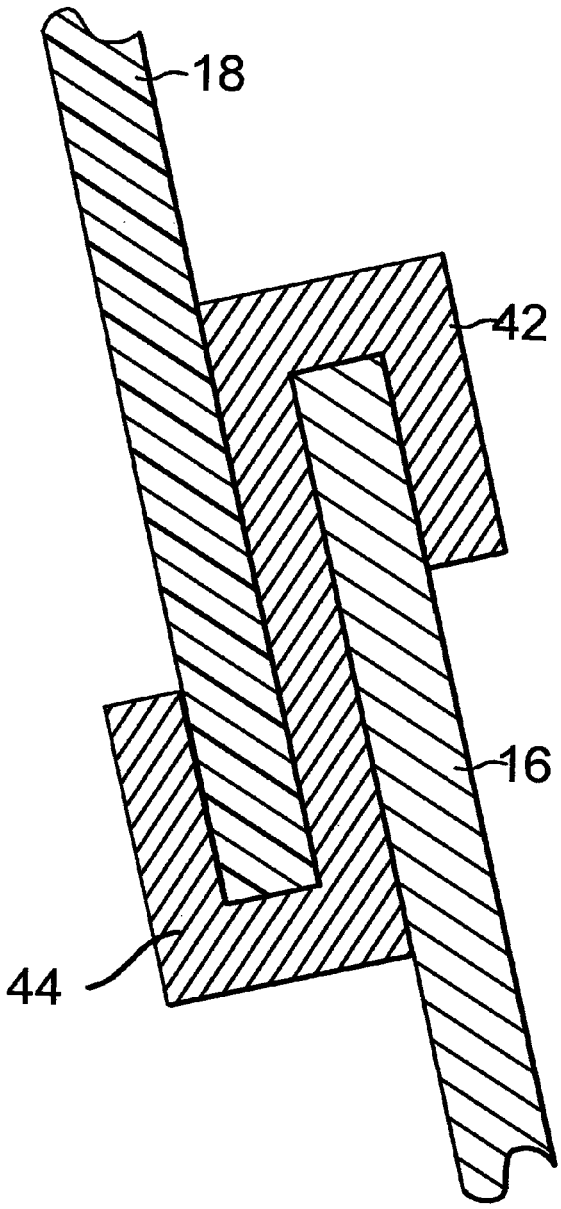
FIG. 5 is a cross-sectional view taken along line 5-5 of FIG. 4.

A bracket assembly is provided to interconnect upper wall 18 to base unit 16. The bracket assembly comprises an S-shaped member 40 that extends along a longitudinal axis and includes and upper channel member 42 that engages the upper edge of front wall 20, and a lower channel member 44 in which the bottom edge of upper wall 18 is positioned (alternatively, this member could simply comprise lower channel 44 attached to or integrally formed with front wall 20), as illustrated in FIG. 5. A pair of upstanding channel members 46, 48 are attached to (or could be integral with) base unit 16 and positioned at opposite ends of S-shaped member 40, and extend along respective longitudinal axes that are parallel to one a other and essentially perpendicular to the axis along which S-shaped member 40 extends. The opposing side edges of upper wall 18 engage channel members 46, 48, respectively, thereby slidably and removably interconnecting upper wall 18 to base unit 16.

What is claimed is:

1. A barrier for placement on a supporting surface, the barrier comprising:

a portable freestanding base assembly comprising a front wall, the front wall extending in a substantially upward direction relative to the supporting surface, the front wall having an upper edge remote from the supporting surface;

a first member secured relative to the front wall such that downward vertical movement of the first member away from the upper edge of the front wall is prevented, at least a portion of the first member positioned below the upper edge of the front wall;

a side channel formed at an angle relative to the first member, at least a portion of the side channel positioned beyond the upper edge of the front wall; and an upper wall comprising at least a portion that is substantially transparent and ballistic resistant, the upper wall having a lower edge, at least a portion of the lower edge received on the first member and a second portion of the upper wall received in the side channel, wherein the upper wall is received within and extends upward from the first member, the lower edge of the upper wall is positioned below the upper edge of the front wall, the upper edge of the upper wall is positioned above the upper edge of the front wall, and a portion of the upper wall overlaps with the front wall, and further wherein the upper wall is movable relative to the first member and removable from engagement with the first member and the side channel.

2. The barrier of claim 1, wherein the front wall and the upper wall comprise a ballistic resistant material.

3. The barrier of claim 1 wherein the barrier further comprises:

a first side wall extending at an angle from the front wall; and a second side wall extending at an angle from the front wall.

4. The barrier of claim 1 wherein the barrier comprises a plurality of wheels located, sized and connected to the barrier so that barrier can roll along the supporting surface.

5. The barrier of claim 1 wherein the upper wall is slidably removable from the first member.

6. The barrier of claim 1 wherein the upper wall comprises a surface that is substantially planar.

7. The barrier of claim 1 wherein the upper wall is at an angle from the vertical when the barrier is supported by the supporting surface in the upright position.

8. The barrier of claim 1 wherein a height of the barrier as measured from the supporting surface is sufficient to protect an entire body of a person situated behind the barrier.

9. The barrier of claim 1, wherein the first member is comprised in a bracket, the bracket having a generally S-shaped cross-section, the first member comprising a channel that receives an edge of the upper wall and a second portion of the S-shaped cross section receiving an edge of the front wall.

10. The barrier of claim 1, further comprising a plurality of wheels mechanically positioned relative to the front wall, the plurality of wheels adapted for rolling on the supporting surface.

11. A moveable barrier for placement on a supporting surface, the barrier comprising:

a portable front wall extending in a substantially upward direction relative to the supporting surface, the front wall having an upper edge remote from the supporting surface;

a plurality of wheels mechanically positioned relative to the front wall, the plurality of wheels adapted for rolling on the supporting surface;

a first member mechanically positioned relative to the front wall such that downward vertical movement of the first member away from the upper edge of the front wall is prevented, at least a portion of the first member positioned below the upper edge of the front wall;

a side channel formed at an angle relative to the first member, at least a portion of the side channel positioned above the upper edge of the front wall; and an upper wall comprising at least a portion that is substantially transparent through and ballistic resistant, the upper wall having a lower edge and an upper edge, at least a portion of the lower edge received on the first member and a second portion of the upper wall received in the side channel, wherein the upper wall extends upward from the first member, the lower edge of the upper wall is positioned below the upper edge of the front wall, the upper edge of the upper wall is positioned above the upper edge of the front wall, and a portion of the upper wall overlaps the front wall, and further wherein the upper wall is movable relative to the first member and the front wall by movement of the upper wall away from the first member.

12. The barrier of claim 11 wherein at least one of the plurality of wheels are in the form of casters.

13. The barrier of claim 11 wherein a height of the barrier is sufficient to protect an entire body of a person situated behind the barrier.

14. A barrier for placement on a supporting surface, the barrier comprising:

a portable freestanding base assembly comprising a front wall, the front wall extending in a substantially upward direction relative to the supporting surface, the front wall having an upper edge remote from the supporting surface;

a first side wall coupled to the front wall and formed at an angle relative to the front wall;

a second side wall coupled to the front wall and formed at an angle relative to the front wall;

a first member mechanically fixed relative to the front wall such that downward vertical movement of the first member away from the upper edge of the front wall is prevented, at least a portion of the first member positioned below the upper edge of the front wall;

a side channel formed at an angle relative to the first member, at least a portion of the side channel positioned beyond the edge of the front wall; and an upper wall comprising at least a portion that is substantially transparent and ballistic resistant, the upper wall having a lower edge and an upper edge, at least a portion of the lower edge received on the first member and a second portion of the upper wall received in the side channel, wherein the upper wall extends upward from the first member, the lower edge of the upper wall is positioned below the upper edge of the front wall, the upper edge of the upper wall is positioned above the upper edge of the front wall, and a portion of the upper wall overlaps with the front wall, and further wherein the upper wall is movable relative to the first member and removable from the barrier by movement of the upper wall away from the first member.

15. The barrier of claim 14 wherein:

the first member is generally U-shaped in cross-section.

16. The barrier of claim 14 wherein the first member is comprised in a bracket, the bracket having a generally S-shaped cross-section, the first member comprising at least a portion shaped as a channel and receiving an edge of the upper wall and a second portion of the S-shaped cross section receiving an edge of the front wall.

* * * * *